US005148936A

United States Patent [19]

DeGrow

[11] Patent Number: 5,148,936

[45] Date of Patent: Sep. 22, 1992

[54] CONTAINER CLOSURE ARRANGEMENT

[75] Inventor: Gary C. DeGrow, Antioch, Tenn.

[73] Assignee: Aladdin Synergetics, Incorporated, Nashville, Tenn.

[21] Appl. No.: 680,904

[22] Filed: Apr. 5, 1991

[51] Int. Cl.[5] ..... B65D 51/18

[52] U.S. Cl. ..... 220/254; 220/336; 220/715

[58] Field of Search ..... 220/90.2, 90.4, 254, 220/271, 336, 713, 714, 715

[56] References Cited

U.S. PATENT DOCUMENTS

| | | | |
|---|---|---|---|
| 981,457 | 1/1911 | Molfenter . | |
| 1,993,745 | 3/1935 | Murch | 221/19 |
| 2,033,042 | 3/1936 | Mazella | 220/336 |
| 2,172,452 | 9/1939 | Rese | 220/336 X |
| 2,447,870 | 8/1948 | Poleyn | 220/254 X |
| 3,048,308 | 8/1962 | Kleid | 222/484 |
| 4,099,642 | 7/1978 | Nergard | 220/90.4 |
| 4,106,665 | 8/1978 | Cannon | 220/329 |
| 4,190,173 | 2/1980 | Mason et al. | 220/254 X |
| 4,712,704 | 12/1987 | Ramsey et al. | 220/254 |
| 4,779,766 | 10/1988 | Kinsley | 222/153 |

*Primary Examiner*—Stephen Marcus
*Assistant Examiner*—Nova Stucker
*Attorney, Agent, or Firm*—Banner, Birch, McKie and Beckett

[57] ABSTRACT

A closure cover for a liquid container includes a body portion that is releasably connected to the container and mounts a stopper member for rotational movement between positions that alternately expose or close dispensing and vent openings in the body portion. The stopper member is provided with limited flexibility to permit release of a sealed closure of the dispensing opening. Also, a centering device is provided on the stopper member to accurately position the visually obscured sealing flange with respect to the dispensing opening before pressure is applied to the stopper member for seating the sealing flange in the dispensing opening.

16 Claims, 3 Drawing Sheets

CONTAINER CLOSURE ARRANGEMENT

BACKGROUND OF THE INVENTION

The present invention relates to closure covers for liquid containers. More particularly, the invention concerns a simple, inexpensively produced closure cover having an opening for dispensing the contents of the container, a vent opening spaced therefrom, and a movable stopper arm for closing the respective openings.

Liquid containers for drinking or pouring purposes, that are formed of plastic material, are well known. Commonly, as for example when such containers are intended for use in the retail dispensation of either hot or cold liquids, they are formed with thermally insulated bodies. The bodies may take the form of a double shell construction with the space between the shells containing a heat insulating medium, such as for example polyurethane foam. Typically, the container at its open, upper end is provided with a closure cover that helps maintain the temperature of the contents of the container as well as to protect against liquid spillage. For liquid dispensing purposes the closure cover is provided with a pair of openings, one of which is particularly suitable for drinking or for pouring the contained liquid. The other opening in the closure cover is particularly intended for use as a vent opening. A stopper member that is movable between open and closed positions is normally provided to seal the openings.

It is to the design and construction of a simple, inexpensive combination of a container closure cover and a movable stopper therefor that the present invention is directed.

SUMMARY OF THE INVENTION

Accordingly, the present invention, in its broadest aspects, provides a closure cover for a container for liquid, or the like, having an annular opening defining a mouth, the closure cover comprising a body portion of an extent sufficient for covering said container mouth and having means thereon for attaching said body portion to said container mouth; a pair of substantially radially aligned openings in said body portion; a stopper member formed of a substantially flat, elongated body mounted on said body portion for movement between a position overlying said openings and a position angularly displaced therefrom for sealedly closing and exposing said openings, respectively; and means for connecting said stopper member to said body portion for rotational movement. Typically, one of the openings is a contents dispensing opening and the other may be particularly adapted for venting purposes.

The stopper member has means thereon for rotatably connecting it to the body portion of the closure cover. It also possesses depending flanges which conform generally in shape to the respective openings in the body portion for reception therein. The flange received in the dispensing opening is adapted to provide a resilient sealing function while that received in the vent hole has a configuration serving, in cooperation with that of the vent hole, for centering or locating purposes as well as to close the opening.

All of the components of the arrangement are desirably formed of a plastic material whereby the stopper member, having a relatively flat body of reduced thickness, bearing a handle on its free end, is imparted with limited flexibility to facilitate insertion and removal of the sealing flange into the dispensing opening. A stiffening rib provided on the stopper member in the region between its pivot connection with the closure cover and the vent hole reduces the danger of flexure of the free end from dislodging the stopper member pivot from its connection with the body portion.

For a better understanding of the invention, its operating advantages and the specific objects obtained by its use, reference should be made to the accompanying drawings and description which relate to a preferred embodiment of the invention.

DESCRIPTION OF A PREFERRED EMBODIMENT OF THE INVENTION

Figure 1:
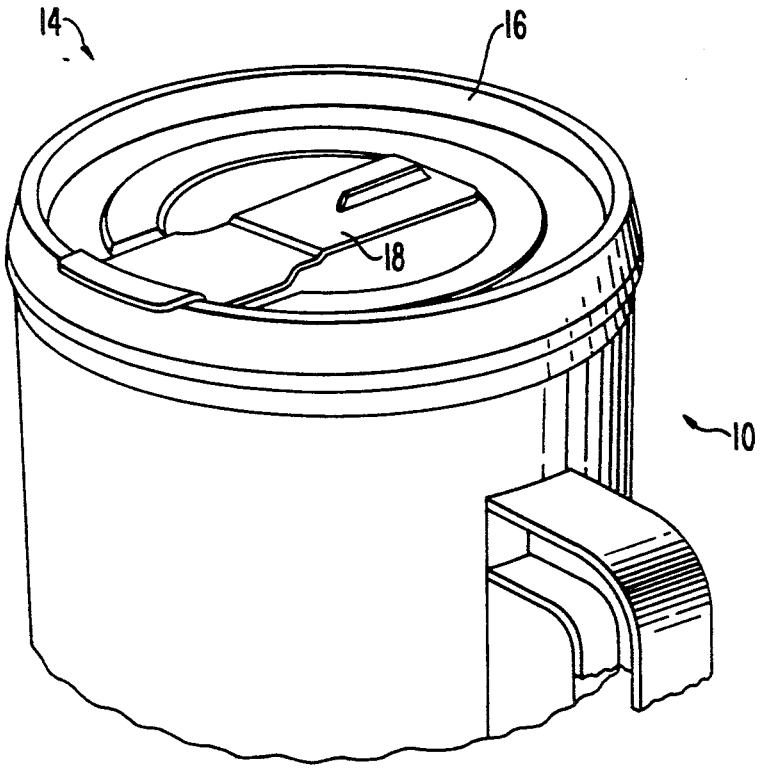
FIG. 1 is an elevational view, partly in section, of a liquid-bearing container organization having a closure cover constructed according to the present invention.
Figure 2:
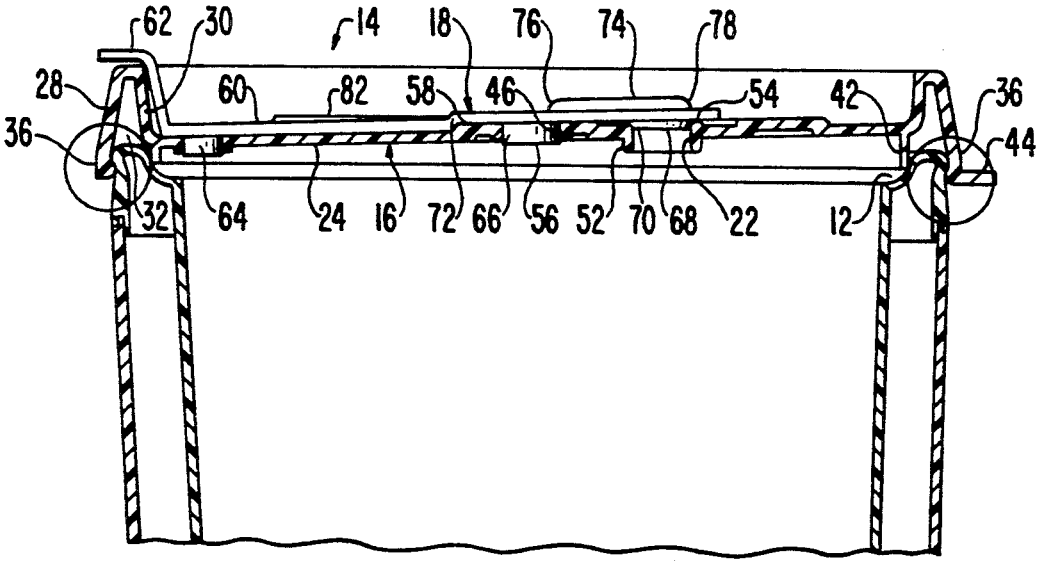
FIG. 2 is a partial sectional elevational view of the liquid container organization shown in FIG. 1.

In FIG. 1 of the drawings there is shown a liquid container, such as a large capacity drinking cup 10, formed from plastic material and having heat insulating capabilities. The particular construction of the illustrated cup 10, although not particularly germane to the present invention, is shown and described in detail in copending U.S. patent application Ser. No. 07/680,757, filed on Apr. 29, 1991 by Burk Wyatt, the disclosure of which is incorporated herein by reference.

The upper open end, or mouth 12, of the container 10 is closed by a closure cover arrangement, indicated generally by the numeral 14, constructed according to the present invention. The closure cover 14 is fixedly secured to the container 10 by means of a flexible sealing connection, as hereinafter more fully described. The closure cover 14 comprises two elemental parts, a body portion 16 and a stopper member 18, both of which may be formed from the same plastic material that forms the container 10. The stopper member 18 is rotatably secured to the body portion 16 for the selective exposure or closure of dispensing and vent openings 20 and 22 with which the body portion is provided.

Figure 3:
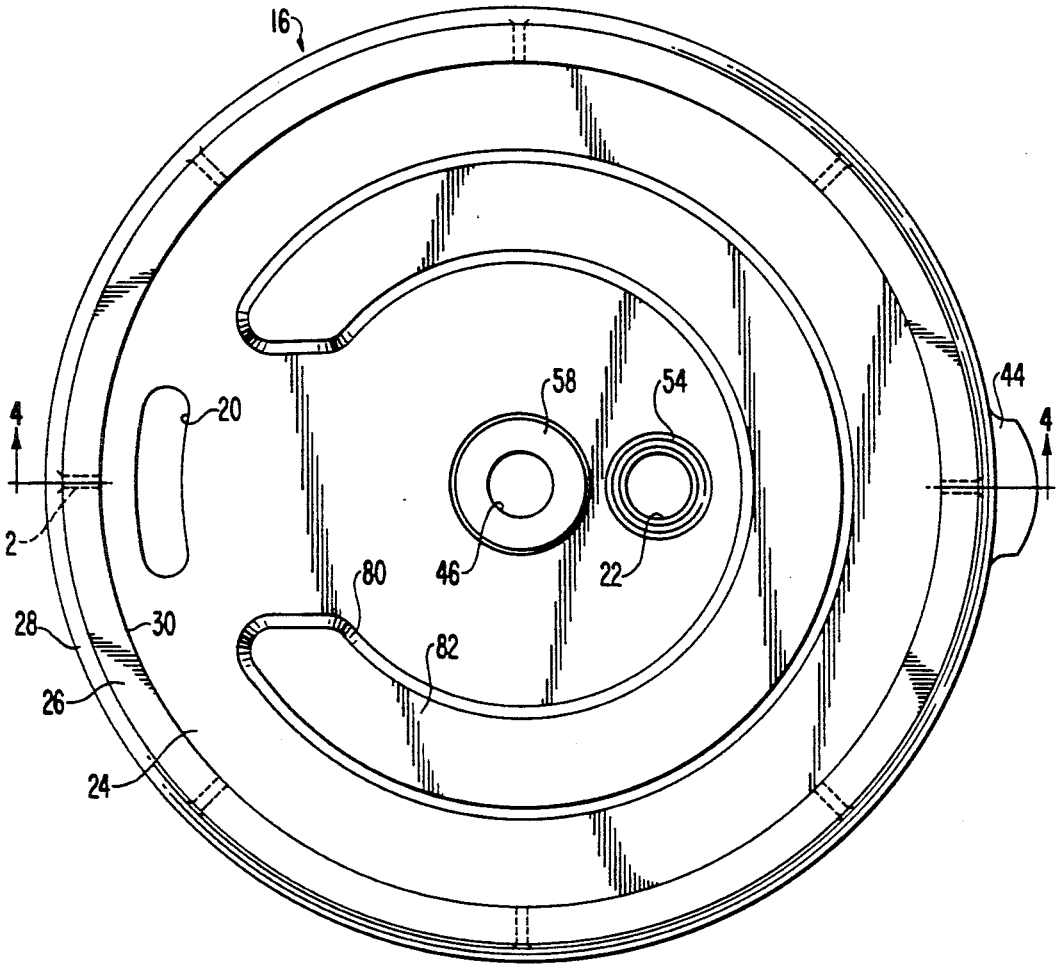
FIG. 3 is a top plan view of the body portion of the closure cover of the present invention.
Figure 4:
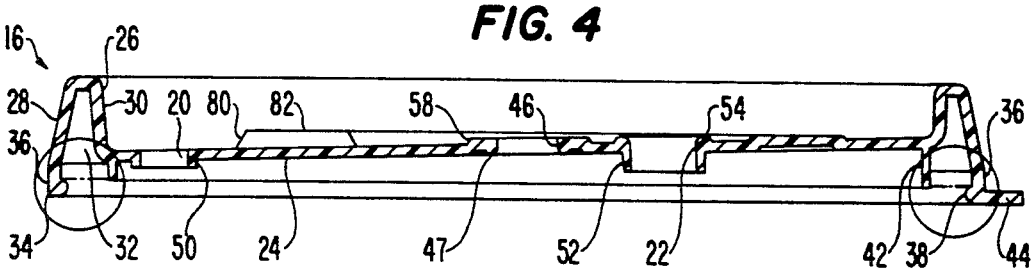
FIG. 4 is an elevational sectional view taken along line 4—4 of FIG. 3.

As best shown in FIGS. 3 and 4 the body portion 16 comprises a circular base 24, around the outer periphery of which an upstanding lip 26 extends. The lip 26 has concentric, upwardly converging sides 28 and 30 that enclose a plurality of radially-extending, circumferentially-spaced gusset-like ribs 32 which stiffen the lip structure. The lower ends 34 of the ribs 32 are arranged in substantial coplanar disposition and are adapted to engage the upper edge of the container mouth 12 for setting the position of the body portion of the closure cover on the container 10. The radially outer side 28 of the lip 26 is made to extend below the lower ends 34 of the ribs 32 to form an annular sealing skirt 36. The skirt 36 is somewhat radially flexible and is provided with a continuous, annular bead-like projection 38 which is adapted to cooperate with an annular recess 40 extending about the container mouth 12 to securely and sealingly attach the closure cover body portion 16 to the container 10. An annular sealing flange 42, concentrically spaced inwardly from the skirt 36 for engagement with the container mouth 12 on the side opposite that engaged by the skirt, provides, in cooperation with the container mouth and the skirt an effective labyrinthine seal against liquid leakage from the container. As shown, the skirt 36 may be provided with a radial tab 44 to facilitate removal of the closure cover assembly 14 from the container 10.

The base 24 of body portion 16 is, as shown in FIG. 3, provided with three radially aligned through-openings, including the dispensing opening 20, the vent opening 22, and an intermediately disposed third opening 46, termed the "axle opening", for reception of a pivot axle on the stopper member 18, as hereafter explained. The dispensing opening 20 is formed with an elongated oval configuration, with the longitudinal axis thereof being arcuate and concentrically disposed with respect to the axle opening 46. The elongated shape of the dispensing opening 20 and its location closely adjacent the lip 26 facilitate the dispensing of liquid from the container 10, either by pouring the liquid into another container, or the like, or directly into the mouth of the user. A stiffening flange 50 depends from the lower surface of the base 24 about the periphery of the dispensing opening 20 and serves to strengthen the edge of the opening.

The vent opening 22 is formed essentially by a circular hole that extends through the body portion base 24. The bottom end of the opening 22 is defined by a generally cylindrical flange 52 which serves as a splash guard and is also useful as a guiding element for reception of a drinking straw (not shown) through this opening. About its upper end the vent opening 22 is surrounded by an annular rib or projection 54 having a flat annular top surface and oppositely facing sides inclined at about 45° angles that provide the rib with a frusto-conical sectional shape. As will be apparent hereinafter, this rib 54 cooperates with a boss of similar structure on the stopper member 18 to center or locate the stopper member in its closed position on the base portion without unduly restricting its rotational movement.

The axle opening 46 is disposed on the central axis of the body portion 16 in radial alignment with the dispensing and vent openings, 20 and 22 respectively. This opening 46, which is somewhat axially extended by flange 47, is adapted to receive the axle lug 56 that operates to permit the stopper member 18 to rotatably move parallel to the plane of the body portion 16. Surrounding the opening 46 is an annular raised boss 58 that effectively spaces the stopper member 18 axially from the surface of the body portion base 24 to facilitate movement of the stopper member with respect to the body portion.

Figure 5:
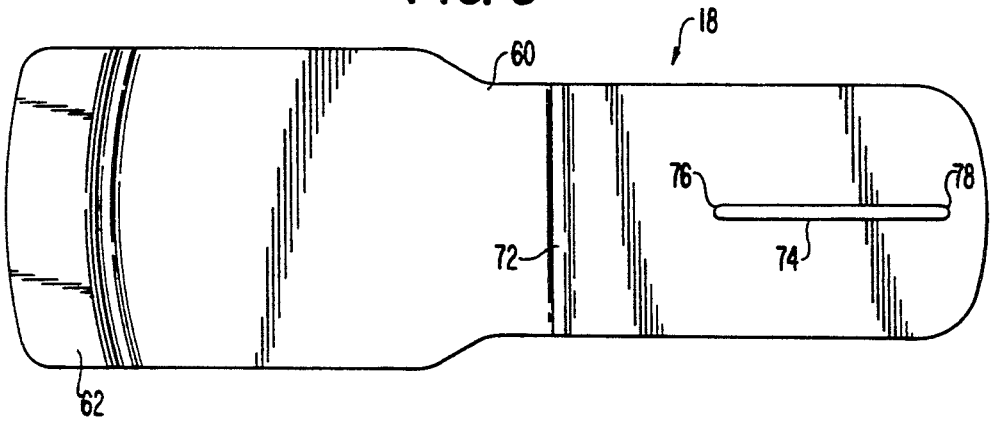
FIG. 5 is a top plan view of the stopper member of the closure cover of the present invention.
Figure 6:
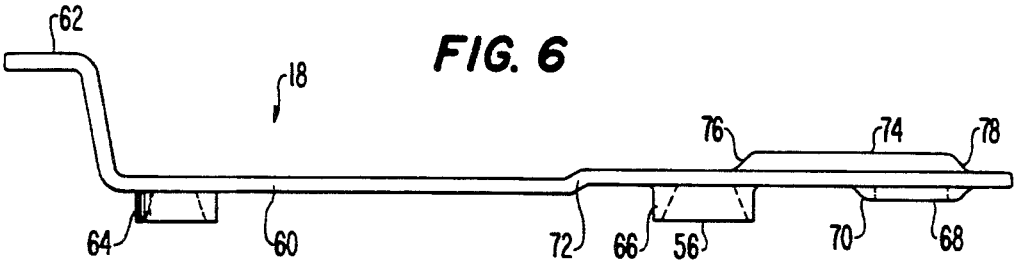
FIG. 6 is a side elevational view of the stopper member shown in FIG. 5.
Figure 7:
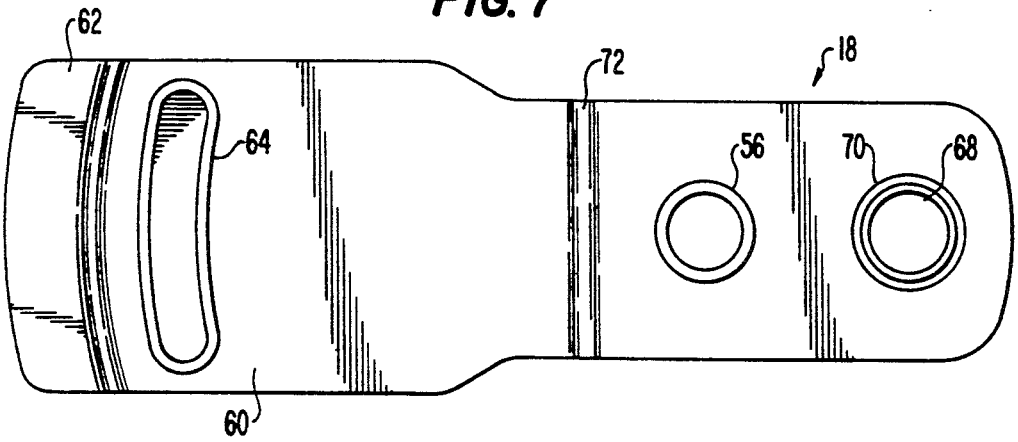
FIG. 7 is a bottom plan view of the stopper member shown in FIG. 4.

The stopper member 18, as shown in FIGS. 5, 6 and 7, is essentially an elongated, flat arm 60 formed of plastic material of relatively reduced thickness. This construction lends some flexibility to the member, particularly adjacent the free end of the arm, which bears the handle 62 and the depending flange 64 for sealing the dispensing opening 20. The axle lug 56, which depends from the underside of the arm 60, is formed as a generally cup-shaped member whose exterior surface about the lower end edge possesses a slight annular enlargement or rib 66. Because of this shape the lug 56 is provided with sufficient flexibility to permit it to be radially compressed for insertion into the axle opening 46 in the base member. Also, retention of the lug 56 in the opening 46 is assisted by the fact that the opening is formed with a downwardly converging, conical sidewall that lends radial flexibility to the flange 47 so that the lug can be simply snapped into the opening and the stopper member securely connected to the base portion for rotational movement.

At its free end the arm is upwardly stepped, to form the handle 62. The sealing flange 64 for the dispensing opening 20 is positioned closely adjacent the handle 62 and has an elongated arcuate shape conforming to the shape of the dispensing opening 20. The flange 64 has tapered sides that converge downwardly so as to render them somewhat flexible in order to cooperate with the drip flange 50 to effect a tight seal when the sealing flange is inserted in the dispensing opening.

On the opposite side of the axle lug 56 from the sealing flange 64, the underside of the arm 60 is formed with an annular centering boss 68 that has a generally frusto-conical sectional shape and an exterior surface 70 inclined at about 45° similar to that of the interior surface of the rib 54 which surrounds the upper end of the vent opening 22. Consequently, as a result of the cooperation between the boss 68 and rib 54, the stopper member 18 can be moved by a user from its open position and accurately disposed so that the sealing flange 64, which is not readily visible to the user, can be inserted into the dispensing opening 20 with the stopper member in its closed position.

As shown in FIG. 6 the arm 60 is desirably provided with a vertical offset 72 to accommodate the presence of the boss 58 between the undersurface of the arm and the upper surface of body portion base 24. Also, in order to restrict the flexibility of the arm 60 to the region adjacent its free end which carries the sealing flange 64, the upper surface of the arm is provided with an elongated stiffening rib 74. The rib 74 extends along the longitudinal axis of the arm 60 with its forward end 76 positioned substantially over the axle lug 54 and its rear end 78 spaced slightly inwardly from the rear end of the arm. Accordingly, by stiffening the stopper member 18 in this region any flexure imparted to the free end of the arm 60 when the handle 66 is lifted will not be propagated sufficiently to the axle lug 56 to break its connection with the body portion 16.

Desirably, the base surface 24 of the body portion 16 is, as shown best in FIG. 4, formed with a downward inclination toward the dispensing opening 20 to assist in returning to the container interior through the opening any liquid that may be discharged onto the base surface. In order to compensate for the inclination of the base surface where a need for vertically stacking a number of containers 10 exists, a generally arcuate stacking boss 80 is, as shown in FIGS. 3 and 4, provided on the upper surface of the base. This boss 80 is particularly designed to accommodate the presence of the stopper member 18 in its closed position and, as shown, has a flat, substantially horizontally disposed bearing surface 82 that is raised sufficiently adjacent the dispensing opening 20 to elevate the bottom surface of a container supported by the boss above the stopper member 18. Also, the boss 80 is, as best shown in FIG. 3, C-shaped in order to provide a space to accommodate the stopper member 18 in its closed position.

In use, the closure cover 14 is removed from the mouth 12 of container 10 by simply lifting the tab 44 on the body portion 16 to release the connection between the sealing skirt 36 and the lip surrounding container mouth. The container 10 can thus be filled with a beverage or other liquid to be carried therein. The closure cover 14, whose dispensing and vent openings 20 and 22 respectively are desirably closed by the stopper member 18, is returned to the mouth 12 of the container by snapping the skirt 36 into place. In this condition the liquid stored in the container 10 can be transported and/or stored for later consumption.

When the user desires to open the closure cover 14 to dispense the contents from the container, the handle 62 on the stopper member 18 is simply lifted to flex the free end of the arm 60 upwardly away from the base 24 of the body portion 16 to thereby release the sealing flange 64 from the dispensing opening 20. The user then rotates or pivots the stopper member, either clockwise or counterclockwise, to expose the dispensing and vent openings 20 and 22.

Thereafter, when it is desired to close the closure cover 14 by returning the stopper member 18 to its closed position, the user rotates the arm 60 until the centering boss 68 on its undersurface is received in the seat formed by the annular rib 54 about the vent opening 22 on the upper surface of the body portion base 24. When the centering boss 68 is seated in the rib 54, the sealing flange 64 is accurately positioned with respect to the dispensing opening 22 so that, in order to seal this opening, the user need only press free end of the arm 60 downwardly to insert the sealing flange into the opening 20.

It will be apparent from the foregoing that the present invention provides a simple, inexpensive, yet reliable apparatus for releasably closing a container, particularly one that is thermally insulated, in order to effectively retain the container contents at the desired temperature. The generally flexible nature of the important component parts of the arrangement facilitate assembly and release of the members as well as to insure against leakage from the connection of the cover to the container or from accidental release of the sealing flange from the dispensing opening.

It will be understood that variations, changes in the details, materials, and arrangement of the parts which have been herein described and illustrated in order to explain the nature of the invention may be made by those skilled in the art within the principles and scope of the invention. What is sought to be protected herein is as recited in the appended claims.

I claim:

1. A closure cover for a container having an annular opening defining a mouth, the closure cover comprising:

a body portion of an extent sufficient for covering said container mouth and having means thereon for attaching said body portion to said container mouth;

a pair of substantially radially aligned openings including a dispensing opening and a vent opening in said body portion, said vent opening including a centering boss therearound projecting upwardly from said body portion;

a stopper member formed of a substantially flat, elongated body mounted on said body portion for movement between a position overlying said openings and a position angularly displaced therefrom for alternately closing and exposing said openings, said stopper member containing means forming downwardly depending flanges conforming in shape to the respective openings in said body portion and forming a seal for said dispensing opening and a centering boss for said vent opening;

said centering boss on said stopper member and said centering boss around said vent opening being formed with cooperating inclined surfaces to facilitate relative movement between said centering bosses; and means for connecting said stopper member to said body portion for rotational movement.

2. The closure cover according to claim 1 in which said side surfaces on said centering bosses are each inclined at an angle of about 45°.

3. The closure cover according to claim 1 including a flange defining a splash guard about said vent opening and extending downwardly therefrom.

4. The closure device according to claim 1 including means forming an axle intermediate said dispensing opening and said vent opening, and means on said stopper member cooperating with said axle forming means for rotatably connecting said stopper member to said body portion.

5. The closure device according to claim 4 in which said axle forming means in said body portion and said stopper member comprise cooperating annular flanges arranged for concentric, mutually connected disposition.

6. The closure device according to claim 5 including an annular bearing surface on said body portion facing oppositely from the flange forming said axle-forming means thereon, and being adapted to bearingly engage the facing surface of said stopper member.

7. The closure device according to claim 4 in which said stopper member is relatively flexible in a direction parallel to the axis of rotation thereof, and including means for stiffening said stopper member in the region between said axle and the centering boss thereon.

8. The closure device according to claim 7 in which said stiffening means comprises an elongated rib extending along said region.

9. The closure device according to claim 8 in which said rib extends outwardly from the upper surface of said stopper member.

10. The closure device according to claim 1 in which said body portion includes an annular lip extending circumferentially about the periphery of said body portion, said lip, at its lower end, containing spaced concentric flanges that cooperate for attaching said closure cover to the mouth of said container.

11. The closure device according to claim 10 in which at least one of said flanges contains a sealing bead thereabout for sealing the connection between said body portion and said container.

12. A closure cover for a container having an annular opening defining a mouth, the closure cover comprising:

a body portion including a surface extending sufficiently to cover said container mouth, said body portion having an annular lip extending circumferentially about the periphery thereof and containing, at its lower end, spaced concentric flanges that cooperate for attaching said closure cover to the mouth of said container;

a pair of radially aligned openings defining a dispensing opening and a vent opening formed in said surface, said surface being inclined downwardly toward said dispensing opening;

a stopper member formed of a substantially flat, elongated body mounted on said body portion for movement between a position overlying said openings and a position angularly displaced therefrom for alternately closing and exposing said openings; and means for conecting said stopper member to said body portion for rotational movement.

13. The closure device according to claim 12 including a generally annular boss upstanding from said surface of said body portion, said boss having an upwardly facing, substantially horizontal bearing surface.

14. A closure cover for a container having an annular opening defining a mouth, the closure cover comprising:

a body portion of an extent sufficient for covering said container mouth, an annular lip extending circumferentially about the periphery of said body portion and including a plurality of circumferentially spaced, internally disposed gusset ribs, said lip, at its lower end, containing spaced concentric flanges that cooperate for attaching said closure cover to the mouth of said container, a pair of substantially radially aligned openings in said body portion;

a stopper member formed of a substantially flat, elongated body mounted on said body portion for movement between a position overlying said openings and a position angularly displaced therefrom, for alternately sealedly closing said openings and exposing them; and means for connecting said stopper member to said body portion for rotational movement.

15. The closure device according to claim 14 in which said gusset ribs have lower ends located in a substantially coplanar disposition for positioning said body portion on said container mouth.

16. A closure cover for a container having an annular opening defining a mouth, the closure cover comprising:

a body portion of an extent sufficient for covering said container mouth, an annular lip extending circumferentially about the periphery of said body portion, said lip, at its lower end, containing spaced concentric flanges that cooperate for attaching said closure cover to the mouth of said container, a pair of substantially radially aligned openings in said body portion;

a stopper member formed of a substantially flat, elongated body mounted on said body portion for movement between a position overlying said openings and a position angularly displaced therefrom, for alternately sealedly closing said openings and exposing them;

means for connecting said stopper member to said body portion for rotational movement; and said stopper member including a stepped offset at its free end defining a handle overlying said body portion lip.

* * * * *